US006537618B2

(12) United States Patent
Lovelace et al.

(10) Patent No.: US 6,537,618 B2
(45) Date of Patent: Mar. 25, 2003

(54) METHOD FOR PREPARING A COATING HOPPER PRIOR TO INITIATION OF COATING

(75) Inventors: Robert E. Lovelace, Fort Collins, CO (US); David W. Gruszczynski, II, Webster, NY (US); Daniel J. Suter, Penfield, NY (US)

(73) Assignee: Eastman Kodak Company, Rochester, NY (US)

( * ) Notice: Subject to any disclaimer, the term of this patent is extended or adjusted under 35 U.S.C. 154(b) by 38 days.

(21) Appl. No.: 09/742,172

(22) Filed: Dec. 20, 2000

(65) Prior Publication Data

US 2002/0114893 A1 Aug. 22, 2002

(51) Int. Cl.[7] ..... B05D 1/26; B05D 1/30; B05D 1/34

(52) U.S. Cl. ..... 427/444; 427/356; 427/402; 427/420

(58) Field of Search ..... 427/356, 402, 427/420, 444; 118/410, 411, DIG. 4

(56) References Cited

U.S. PATENT DOCUMENTS 5,224,996 A * 7/1993 Ghys et al. ..... 118/325

5,403,622 A * 4/1995 Nishi et al. ..... 427/356

FOREIGN PATENT DOCUMENTS

GB 2 234 457 A * 2/1991

* cited by examiner

*Primary Examiner*—Katherine A. Bareford
(74) *Attorney, Agent, or Firm*—Mark G. Bocchetti

(57) ABSTRACT

A method is taught for preparing a coating hopper prior to initiation of coating a liquid coating composition at a predetermined coating flow rate onto a moving substrate wherein the coating hopper includes at least one internal flow path therethrough. The internal flow path(s) of the coating hopper are drained. The liquid coating composition is introduced into internal flow path(s) at a purge flow rate which may be determined empirically. The internal flow path(s) are filled with the liquid coating composition and with the liquid coating composition then discharging from the internal flow path(s) onto a slide surface of the coating hopper, the liquid coating composition flowing down the slide surface and over a lip of the coating hopper at the purge rate to a drain. The flow of the liquid coating composition through the internal flow path(s) is maintained at the purge rate until air within the internal flow path(s) has been displaced from the coating hopper. Preferably, the internal flow path(s) are flushed with water prior to draining.

19 Claims, 3 Drawing Sheets

METHOD FOR PREPARING A COATING HOPPER PRIOR TO INITIATION OF COATING

FIELD OF THE INVENTION

The invention relates to delivery of a liquid composition to a substrate surface to form a coated layer thereupon, more particularly to a method and apparatus for preparing a coating hopper prior to initiation of delivery of a composition to a substrate surface, and most particularly to such a method and apparatus wherein composition is introduced into an empty coating hopper.

BACKGROUND OF THE INVENTION

In forming a flowing sheet of a liquid composition for coating onto a substrate surface, the shape of flowing liquid composition is reconfigured from flow through a typically cylindrical conduit to flow though any of a variety of apparatus that create a sheet flow. These apparatus for creating a sheet flow are well known in the art and include, for example, a die, a distributor, an extruder, a weir, a slide surface, and a hopper. As used herein, all such types of apparatus are referred to collectively as hoppers. A hopper may comprise one or more parallel longitudinal members (typically referred to as hopper bars in the art) which are oriented transverse to the direction of liquid flow, which members may be bolted together or otherwise attached to form a hopper unit. A primary member may be referred to as a "hopper body," and one or more secondary members as "hopper bars." Typically, hopper bars are configured on their mating surfaces in such a way that internal flow passages for the composition are formed within the hopper when the bars are assembled together. Within a hopper, a flow path for liquid composition typically includes (in flow sequence) an inlet, one or more transverse distribution voids known as cavities, and a slotted exit from each cavity communicating with either a successive cavity or the exterior of the hopper. The last such slot is commonly known as an exit slot. Alternatively, a hopper distribution apparatus may include a distribution chamber open at the top and having a wall forming a weir for overflow cascade or curtain coating therefrom, the wall and weir being within the scope of the current invention.

In an extrusion hopper, the downstream end of the exit slot typically defines a coating lip from which the extruded sheet of composition is transferred directly to the passing substrate. In slide hoppers, as are used typically in the manufacture of photographic films and papers, composition is extruded from the exit slot onto an inclined slide surface terminating at a lower edge in a coating lip. The extruded sheet flows down the slide surface under gravity and is transferred to the passing substrate either through a dynamic bead, as in bead coating, or a falling curtain, as in curtain coating.

It is well known in the art that bubbles or particulate debris may be carried into or formed within a hopper and can become lodged in the composition flow path at any of numerous locations in or on the hopper. These bubbles and/or particulates can subsequently cause flow disturbances during coating resulting in unacceptable and continuous thickness variations in the coating as applied to the substrate. Further, such bubbles and debris may become dislodged during coating and be transferred to the substrate, resulting in unacceptable discontinuous thickness variations. Thus, it becomes very important that all debris and bubbles be eliminated from a hopper prior to commencing a coating operation. A strategy in the known art for accomplishing this is to conduct any of various rigorous hopper cleaning protocols using flush water. Typically, these protocols involve supplying particle-free and bubble-free flushing water through a coating composition/water manifold and valve arrangement positioned proximate to the coating hopper. The particle-free and bubble-free flushing water is pumped continuously through the hopper to a drain, the hopper being out of coating position. Mechanical devices such as plastic picks may be inserted into the hopper and agitated to assist in dislodging bubbles and composition residues from prior coatings into the flush water. Typically, such cleaning of a coating hopper used to coat radiation-sensitive coatings is conducted under white lights during a delay or product change in the coating operation. Flush cleaning may proceed for several minutes or more, until an operator is satisfied that no further composition or bubbles are exiting the hopper, and that the hopper is ready for introduction of composition.

One common method of coating hopper preparation used in the photographic coating art is to flush the hopper with water to displace air from the hopper much as described above. Once the flushing with water step is completed then coating composition is used to displace the water from the hopper, resulting in a hopper that is apparently ready for coating. Ideally, after all air and particulates have been displaced from the hopper, liquid coating composition is introduced into the hopper through the coating composition/water manifold and valve arrangement mentioned above. Specifically, the flow of flush water is stopped and the flow of liquid coating composition is begun. The liquid coating composition then begins to displace the water. Because the coating composition typically is an aqueous gelatin solution or emulsion, and because flow is not laminar through much of the flow path, the displacement typically does not occur as plug flow but rather there is substantial mixing of the coating composition with the residual water in the hopper. In good practice, the hopper may not be moved into coating position and coating may not commence until substantially all the residual water is eliminated from the hopper, and the slide surfaces and coating lip are observed to be conveying composition with absolute visual uniformity and no dilution.

For multiple-slot hoppers that simultaneously deliver a plurality of superimposed layers of coating compositions to form a multiple-layer composite coating, it is typical that the individual slots in the coating hopper are changed over from flush water to coating composition sequentially. It is also typical that the lower-most hopper slot is changed over first and the higher coating slots are changed over in sequence moving up the slide hopper surface. However, because in some facilities and coating applications, the top layer is more critical than the lower layers, it is sometimes preferable to purge the upper-most hopper slot first and purge sequentially down the hopper to purge the lower slots. The quality of hopper preparation for each slot is confirmed before the next slot is changed over. Thus the lower compositions may be flowed to drain for an extended period of time before the hopper preparation is complete.

In the practice of the method of the present invention purging of all of the hopper slots can also be performed simultaneously. To purge simultaneously the coating compositions flowing to each slot should reach the slide surface of the slide hopper at about the same time. Purge flow rates, coating composition delivery line lengths and head losses, and coating composition viscosity and density will all have to be considered if a simultaneous purge of all of the coating slots is contemplated.

Further, each composition delivery system typically is changed over from flush water to composition flow at a purge flow rate (which is significantly higher than the actual coating composition flow rate) to displace water more rapidly. The length of time required for the purge flow step and the actual flow rate during the purge flow step is typically empirically determined for each coating hopper and the various coating compositions used therein. However, in all cases, a large amount of coating composition may be wasted in displacing water from the hopper. Therefore, the known art hopper preparation method is costly, both in terms of lost machine time and in terms of coating composition waste.

What is needed is an improved method whereby a clean hopper can be filled with coating composition and prepared for coating initiation in a shorter time and with reduced composition waste as compared with the known art method.

SUMMARY OF THE INVENTION

It is therefore an object of the present invention to reduce the amount of coating composition wasted in preparing a coating hopper prior to initiation of coating.

It is a further object of the present invention to reduce the time required to prepare a coating hopper prior to initiation of coating.

Yet another object of the present invention is to prevent the starting of a coating with composition which is diluted with water due to incomplete purging of residual flush water.

Briefly stated, the foregoing and numerous other features, objects and advantages of the present invention will become readily apparent upon a review of the detailed description, claims and drawings set forth herein. These features, objects and advantages are accomplished preferably by flowing flush water through the coating hopper (which may be a slide hopper or an extrusion hopper), the flush water filling the internal passages and exiting an exit slot or die, draining the flush water from the coating hopper, and flowing a coating composition at a purge flow rate through the coating hopper and across the external surfaces of the hopper normally wetted by coating composition. The purge flow rate may be greater than, equal to, or less than an actual or predetermined coating flow rate depending on a number of factors discussed hereinafter. With a slide hopper coating operation the flush water also covers the slide surface of the coating hopper. Alternatively, the method of the present invention may be practiced by flowing a coating composition through the coating hopper at a purge flow rate which is greater than an actual or predetermined coating flow rate while not performing a precursor water flush step at all.

The purge flow rate for purging with coating composition will vary from system to system. Although the purge flow rate will generally be greater than the actual or predetermined coating flow rate, the purge flow rate is actually dependent upon a number of factors. These factors include the viscosity and density of the coating composition, whether or not the coating composition is Newtonian in nature, whether or not the coating composition contains a surfactant, and the internal geometry of the coating hopper. A higher viscosity will generally allow for purging to take place at a lower purge flow rate. Similarly, a higher density will generally allow for purging to take place at a lower purge flow rate. As to whether or not the coating composition is Newtonian, Newtonian fluids are generally better for purging air.

Further, it should be appreciated that if the components of the coating delivery system are more difficult to purge of air than the coating hopper itself then such components should be positioned upstream of the coating hopper drain valve. Also, that portion of the coating supply line from hopper drain valve up to the hopper should be oriented to have at least some vertical slope component such that the drain valve is at the lowest position and such that there is no horizontal or sagging section in the supply line between the drain valve and the hopper. Horizontal lines and lines with sags are an obstacle to the air purging process.

The method of the present invention is useful in providing uniform coatings of liquid compositions to moving webs.

DETAILED DESCRIPTION OF THE INVENTION

Figure 1:
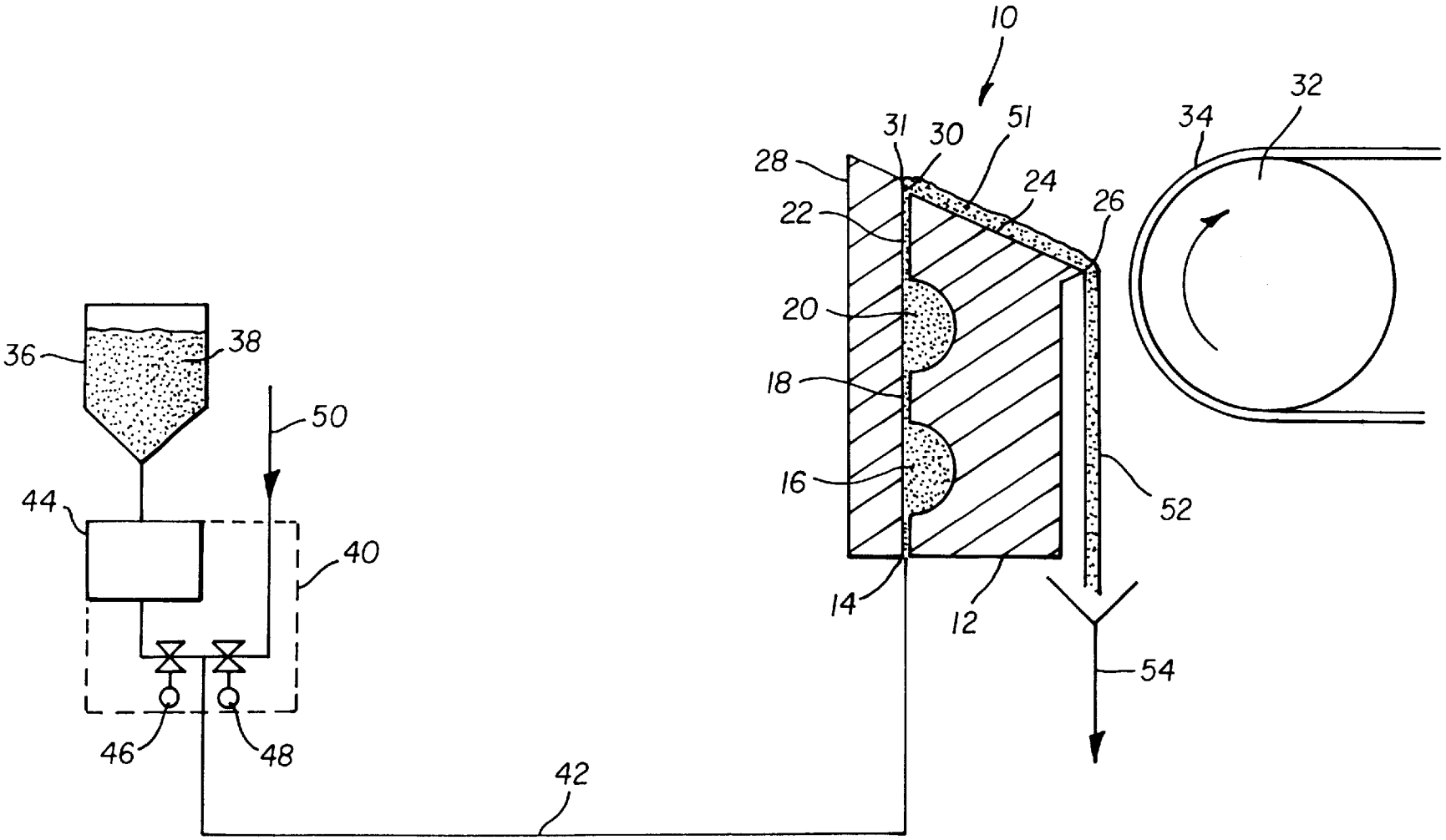
FIG. 1 is a schematic diagram of a single-slot hopper for coating a single layer of a liquid composition.

Turning first to FIG. 1, there is depicted a schematic of a single-slot coating hopper 10. Hopper 10 is formed as is well known in the coating art and is shown as a dual-cavity single-slide extrusion hopper, although other well-known types of hoppers, extruders, and dies as described above may also benefit from use of the present invention. Hopper 10, shown in elevational cross-section, includes a front section 12 having an inlet 14, a primary transverse distribution cavity 16, an inner slot 18, a secondary transverse distribution cavity 20, an outer or metering slot 22, an inclined slide surface 24, and a coating lip 26. Hopper 10 further includes a back plate 28 which extends above inclined slide surface 24 to form a back land surface 30 having an upper corner 31. The inlet 14, slots 18, 22, and distribution cavities 16, 20 comprise internal passages of the hopper 10, and the back land surface 30, slide surface 24, and lip 26 comprise the external surfaces of the hopper 10.

Residing adjacent the hopper 10 is a coating backer roller 32 about which a web 34 is conveyed. Typically, the hopper 10 is movable from a non-coating position toward the coating backer roller 32 and into a coating position.

There is a vessel 36 in which a liquid coating composition 38 is stored. The liquid coating composition 38 in vessel 36 is pumped via a composition delivery system 40 through delivery line 42 to inlet 14 of hopper 10. Such a delivery system 40 is well known in the art, comprising apparatus and controls for metering flow, maintaining temperature, eliminating bubbles, and like functions, shown as unit 44 within delivery system 40, and need not be further described herein.

In delivery system 40, there is a composition control valve 46 for starting and stopping the flow of composition from vessel 36 through delivery line 42 to hopper inlet 14. There is also a flush water control valve 48 for starting and stopping the flow of flush water from a source 50 through delivery line 42 to the inlet 14 of hopper 10. With hopper 10 residing in a non-coating position, water from source 50, or coating composition 38 from vessel 36, or a combination of both water and coating composition 38 may be delivered to inlet 14 of hopper 10. The liquid fills transverse cavities 16, 20 and is transmitted therethrough to slots 18, 22. Upon exiting slot 22 the liquid forms a layer 51 flowing down slide surface 24 and over lip 26 to form a free-falling liquid curtain 52. In the non-coating position the free-falling curtain 52 is captured in drain 54.

In operation in accordance with a prior art method of preparing a coating hopper 10, for coating, flush water control valve 48 is opened to pass flush water through the inlet 14, transverse cavities 16, 20, slots 18, 22. The flush water then flows down the slide surface 24, and off the lip 26 into drain 54. Flushing is continued until all air is removed from the internal passages and no bubbles or particles are detected clinging to the hopper 10 anywhere in the composition flow path. The flush water control valve 48 then is gradually closed and, simultaneously, composition control valve 46 is gradually opened, and unit 44 begins delivering composition 38 at a pre-determined flow rate through delivery line 42 to hopper 10 to displace residual flush water from the hopper 10 to the drain 54. As already noted above, such displacement may require up to several minutes of composition flow, at a significant waste in composition and coating machine time.

Figure 2:
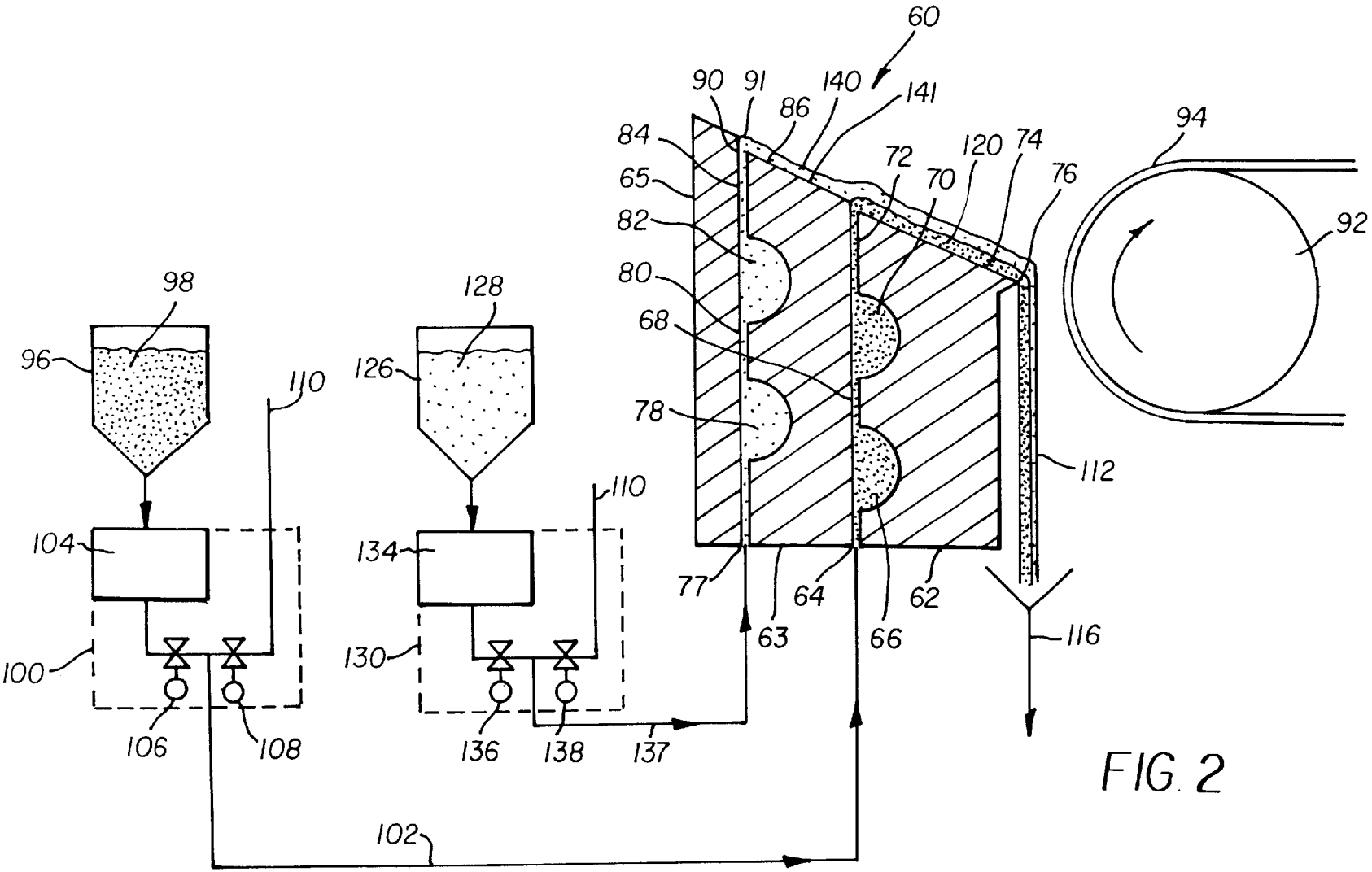
FIG. 2 is a schematic diagram similar to FIG. 1 showing a multiple-slot coating hopper for simultaneously coating a plurality of liquid compositions as a composite layer.

Referring next to FIG. 2, there is schematically depicted a well known multi-slot coating hopper 60 which may be used to deliver and coat multiple coating compositions simultaneously as a stacked composite of layers. Coating hopper 60 is shown as having only two slots for purposes of simplicity but multiple slot hoppers are known which can deliver a composite layer comprised of five or six (or even more) coating composition layers. Operationally, hopper 60 and the accompanying supply system is similar to that discussed above with reference to hopper 10.

Hopper 60, shown in elevational cross-section, includes a front section 62 having an inlet 64, a middle section 63, and a back plate 65. There is a primary transverse distribution cavity 66, an inner slot 68, a secondary transverse distribution cavity 70, and an outer or metering slot 72 between front section 62 and middle section 63. Front section 62 includes an inclined slide surface 74, and a coating lip 76. There is an inlet 77, a primary transverse distribution cavity 78, an inner slot 80, a secondary transverse distribution cavity 82, and an outer or metering slot 84 between middle section 63 and back plate 65. There is an inclined slide surface 86 at the top of middle section 63. Back plate 65 extends above inclined slide surface 86 to form a back land surface 90 having an upper corner 91. The inlets 64, 77, inner slots 68, 80, outer slots 72, 84, and distribution cavities 66, 70, 78, 82 comprise internal passages of the hopper 60, and the back land surface 90, slide surface 74, 86 and lip 76 comprise the external surfaces of the hopper 60.

Residing adjacent the hopper 60 is a coating backing roller 92 about which a web 94 is conveyed. Typically, the hopper 60 is movable from a non-coating position toward the coating backing roller 92 and into a coating position.

There is a vessel 96 in which a first liquid coating composition 98 is stored. The liquid coating composition 98 in vessel 96 is pumped via a composition delivery system 100 through delivery line 102 to inlet 64 of hopper 60. Such a delivery system 100 is well known in the art, comprising apparatus and controls for metering flow, maintaining temperature, eliminating bubbles, and like functions, shown as unit 104 within delivery system 100, and need not be further described herein.

In delivery system 100, there is a composition control valve 106 for starting and stopping the flow of composition from vessel 96 through delivery line 102 to hopper inlet 64. There is also a flush water control valve 108 for starting and stopping the flow of flush water from a source 110 through delivery line 102 to the hopper inlet 64 of hopper 60. With hopper 60 residing in a non-coating position water from source 110, or coating composition 98 from vessel 96, or a combination of both water and coating composition 98 may be delivered to inlet 64 of hopper 60. The liquid fills transverse distribution cavities 66, 70 and is transmitted therethrough to outlet slot 72. Upon exiting slot 72 the liquid forms a layer 120 flowing down slide surface 74 and over lip 76 to form a free-falling liquid curtain 112. In the non-coating position the free-falling curtain 112 is captured in drain 116.

There is a vessel 126 in which a second liquid coating composition 128 is stored. The liquid coating composition 128 in vessel 126 is pumped via a composition delivery system 130 through delivery line 137 to inlet 77 of hopper 60. Delivery system 130 is identical to delivery system 100.

In delivery system 130, there is a composition control valve 136 for starting and stopping the flow of composition from vessel 126 through delivery line 137 to hopper inlet 77. There is also a flush water control valve 138 for starting and stopping the flow of flush water from a source 110 through delivery line 137 to inlet 77 of hopper 60. With hopper 60 residing in a non-coating position water from source 110, or coating composition 128 from vessel 126, or a combination of both water and coating composition 128 may be delivered to inlet 77 of hopper 60. The liquid fills transverse distribution cavities 78, 82 and is transmitted therethrough to outer slot 84. Upon exiting slot 84 the liquid forms a layer 140 flowing down slide surface 86, over layer 120 on slide surface 74, and over lip 76 to form a free-falling liquid curtain 112. In the non-coating position the free-falling curtain 112 is captured in drain 116.

The prior art method of preparation of hopper 60 is substantially the same as the preparation of hopper 10 as described above. Flushing of the internal flow paths is preferably performed sequentially. Flush water control valve 108 is opened to pass flush water through the inlet 64, transverse cavities 66, 70, and slots 68, 72. The flush water then flows down the slide surface 74, and off the lip 76 into drain 116. Flushing is continued until all air is removed from the internal passages of that portion of hopper 60 and no bubbles or particles are detected clinging to the hopper 60 anywhere in the composition flow path. Flush water control valve 138 is then opened to pass flush water through the inlet 77, transverse cavities 78, 82, and slots 80, 84. The flush water then forms a layer 140 that flows down the inclined slide surface 141, and off the lip 76 into drain 116. Flushing is continued until all air is removed from the internal passages of that portion of hopper 60 and no bubbles or particles are detected clinging to the hopper 60 anywhere in the composition flow path. The flush water control valves 108, 138 are then gradually closed sequentially and, simultaneously, composition control valves 106, 136 are gradually opened sequentially, and units 104, 134 begin delivering compositions 98, 128 at a pre-determined flow rate through lines 102, 137 to hopper 60 to displace residual flush water from the hopper 60 to the drain 116. As already noted above, such displacement may require up to several minutes of composition flow, at a significant waste in composition and coating machine time.

It has now been surprisingly found that a hopper can be prepared much more efficiently in terms of composition waste and machine down time, and with at least equal reliability in terms of purging of hopper air, by filling the empty hopper directly with the liquid coating composition rather than using the prior art strategy of first purging all hopper air with water and then purging water with the liquid coating composition. Preferably the method of the present invention is practiced by first flushing the hopper with water and then draining the hopper prior to purging the hopper with the liquid coating composition(s).

Figure 3:
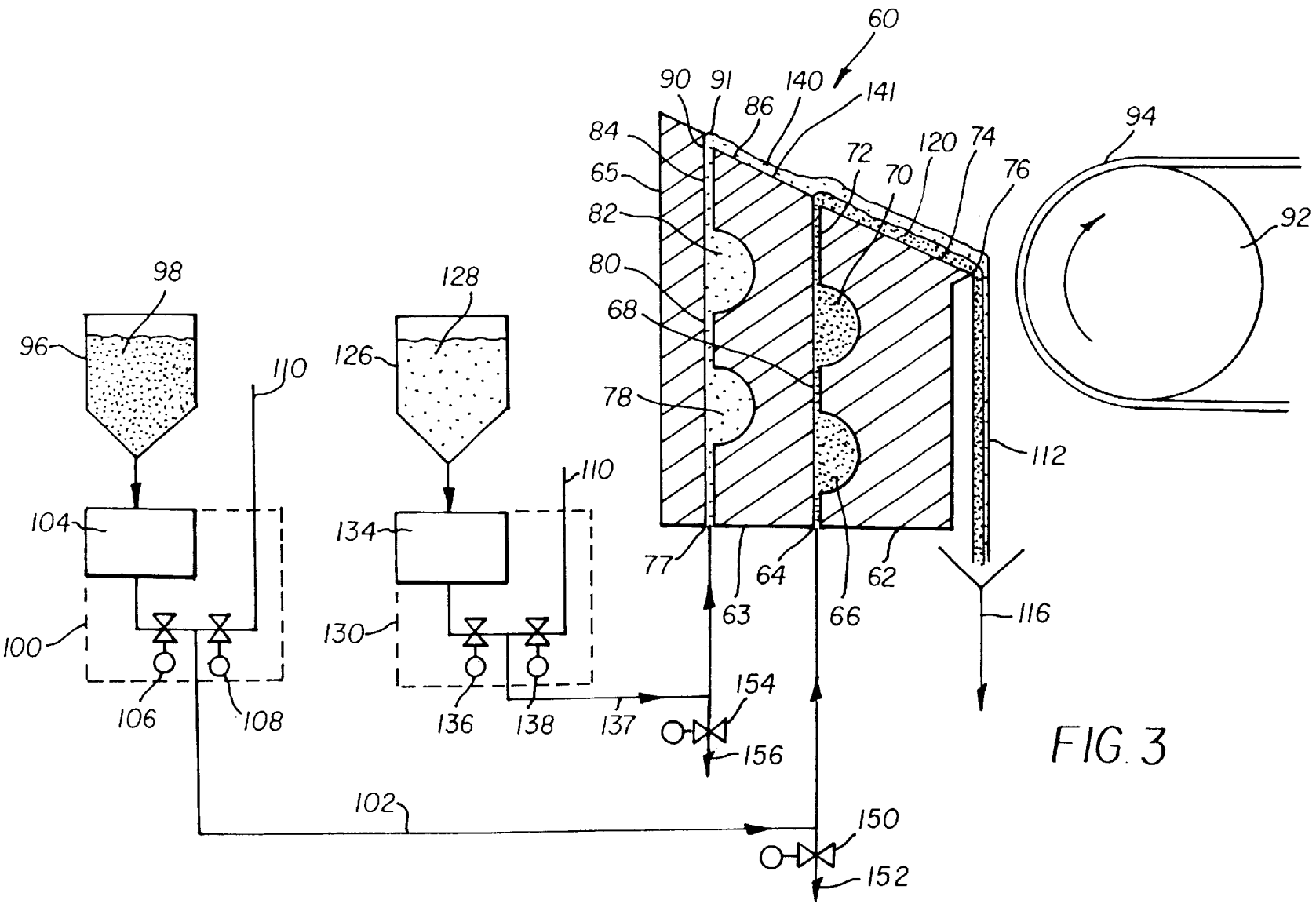
FIG. 3 is a schematic diagram of the same multiple-slot coating hopper shown in FIG. 2 modified with valving and drain lines to allow for the practice of the method of the present invention for preparing a hopper for coating.

The method of the present invention will be discussed with reference to FIG. 3 which is identical to FIG. 2 with the exceptions of a drain valve 150 and drain leg 152 in delivery line 102, and drain valve 154 and drain leg 156 in conduit 137. For simplicity, all other elements in FIG. 3 are numbered identically to their counterparts in FIG. 2.

In the practice of the method the present invention, valves 106, 136 are opened to introduce composition 98, 128 into delivery lines 102, 137 to flow into hopper 60. Preferably, an initial purge flow rate is established for each composition 98, 128 which typically is significantly higher than the eventual coating flow rate. It is more efficient in terms of liquid waste to deliver composition at a high flow rate for a short period of time than at a lower flow rate for a longer period of time. After an internal flow path (e.g. inlet 64, transverse distribution channels 66, 70, inner slot 68 and outer slot 72) has been purged of air, the flow rate is reduced to the coating flow rate, and once all flow paths through the hopper 60 are purged, coating can commence.

Preferably, in a multiple layer delivery, composition flows in the multiple delivery systems are timed and sequenced, based on the length of delivery lines 102, 137, such that all compositions arrive at their respective hopper slide surfaces 74, 141 simultaneously, as this promotes the most uniform wetting of the slide surfaces and hopper lip 76. To ensure, however, that upper layer(s) 140 do not inadvertently arrive first and flow down into the empty slots of lower layers, the timing of the lower layers may be sequence-biased such that the lowermost composition arrives first.

In practice, the hopper 60 is preferably cleaned and flushed with water as described above in the prior art method, either after installation of the hopper 60 or at the conclusion of a coating event to prepare for the next coating event. Thus, to facilitate hopper preparation in accordance with a method of the present invention, means are preferably provided for easy and automatic draining of flush water from the hopper prior to introduction of composition. Draining of the flush water is accomplished with drain valve 150 and drain leg 152 in delivery line 102, and drain valve 154 and drain leg 156 in delivery line 137 which are installed at the lowest point of each delivery line 102, 137. In practice, preferably, the drain valves 150, 154 are disposed at elevations lower than inlets 64, 77 so that delivery lines 102, 137 are routed upwards to hopper 60 to aid in displacement of air by coating composition. Preferably, each drain valve 150, 154 may be opened and closed either automatically as part of a pre-determined hopper preparation procedure, or manually by an operator as desired. Preferably, each drain leg 152, 156 is also provided with a conductivity sensor and alarm (not shown) to prevent coating of incorrect composition thickness in the event the drain valve is not fully closed or leaks during coating. In operation, each drain valve 150, 154 is opened for a pre-determined length of time at the conclusion of flush cleaning to allow for substantially all water to drain from the composition flow portions of the hopper 60. The drain valves 150, 154 are then closed prior to introduction of composition 98, 128 into the hopper 60.

It is not necessary that the internal surfaces of the hopper 60 be completely dry when compositions 98, 128 are introduced into the hopper 60. However, to promote uniform distribution of compositions 98, 128 on the hopper slide surfaces 74, 141, it is advantageous to precondition the hopper slide surface such that it is wettable. This may be readily achieved by stopping the flow of flush water, applying a surfactant to the slide surface and hopper lip, and then resuming flow of flush water for a short time to rinse away excess surfactant. Exemplary surfactants that may be used include SPO (2-(2-(4-(1,1,3,3-tetramethylbutyl)phenoxy) ethoxy)-ethanesulfonic acid, sodium salt in water), and Alkanox XC (Naphthalenesulfonic acid, sodium salt isopropylated in water).

It is highly desirable that both back land 90 and lip 76 be scrupulously clean and dry to achieve a uniform transverse wetting line of composition at the back land 90 and on the backside of the lip 76. Thus, when water flow is subsequently stopped and draining has commenced, the back land, slides, edging, and hopper lip preferably are manually dried with a lint-free fabric.

Using the prior art protocol, typically between 2 and 6 minutes of composition flow at between 2 and 5 liters per minute are required to completely purge water from a hopper having a 50 to 60 inch coating width, thus consuming between 2 and 30 liters of composition, and typically at least 6 liters.

In contrast, using the method of the present invention, the same hopper can be purged in less than 1 minute, and in many cases in only 10 to 20 seconds. Thus, typical composition waste is less than 2 liters, and in most cases is less than 1 liter, at a savings of at least 5 minutes of machine time and removal of concern for accidental dilution of composition at the start of a coating by incompletely-purged residual flush water as can happen with the prior art method.

From the foregoing, it will be seen that this invention is one well adapted to obtain all of the ends and objects hereinabove set forth together with other advantages which are apparent and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth and shown in the accompanying drawings is to be interpreted as illustrative and not in an illuminating sense.

PARTS LIST

| | |
|---|---|
| 10 | single slot coating hopper |
| 12 | front section |
| 14 | inlet |
| 16 | primary transverse distribution cavity |
| 18 | inner slot |
| 20 | secondary transverse distribution cavity |
| 22 | outer or metering slot |
| 24 | inclined slide surface |
| 26 | coating lip |
| 28 | back plate |
| 30 | back land surface |
| 31 | upper corner |
| 32 | coating backing roller |
| 34 | web |
| 36 | vessel |
| 38 | liquid coating composition |
| 40 | delivery system |
| 42 | delivery line |
| 44 | unit comprising apparatus and controls |
| 46 | composition control valve |

-continued

| PARTS LIST | |
|---|---|
| 48 | flush water control valve |
| 50 | flush water source |
| 51 | layer |
| 52 | liquid curtain |
| 54 | drain |
| 60 | multi-slot coating hopper |
| 62 | front section |
| 63 | middle section |
| 64 | inlet |
| 65 | back plate |
| 66 | primary transverse distribution cavity |
| 68 | inner slot |
| 70 | secondary transverse distribution cavity |
| 72 | outer or metering slot |
| 74 | inclined slide surface |
| 76 | coating lip |
| 78 | primary transverse distribution cavity |
| 80 | inner slot |
| 82 | secondary transverse distribution cavity |
| 84 | outer or metering slot |
| 86 | inclined slide surface |
| 90 | back land surface |
| 91 | upper corner |
| 92 | coating backing roller |
| 94 | web |
| 96 | vessel |
| 98 | first liquid coating composition |
| 100 | delivery system |
| 102 | delivery line |
| 104 | unit comprising apparatus and controls |
| 106 | composition control valve |
| 108 | flush water control valve |
| 110 | flush water source |
| 112 | liquid curtain |
| 116 | drain |
| 120 | layer |
| 126 | vessel |
| 128 | second liquid coating composition |
| 130 | delivery system |
| 134 | unit comprising apparatus and controls |
| 136 | composition control valve |
| 137 | delivery line |
| 138 | flush water control valve |
| 140 | layer |
| 141 | inclined slide surface |
| 150 | drain valve |
| 152 | drain leg |
| 154 | drain valve |
| 156 | drain leg |

What is claimed is:

1. A method for preparing a coating hopper prior to initiation of coating a liquid coating composition at a predetermined coating flow rate onto a moving substrate, the coating hopper having at least one internal flow path therethrough, the method comprising the steps of:

(a) draining the at least one internal flow path;

(b) introducing the liquid coating composition into each of the at least one internal flow path(s) at a purge flow rate;

(c) filling the at least one internal flow path with the liquid coating composition and discharging the liquid coating composition from the at least one internal flow path through an exit slot, the liquid coating composition flowing over a lip of the coating hopper at the purge rate to a drain;

(d) maintaining the flow of the liquid coating composition through the at least one internal flow path at the purge rate until air within the at least one internal flow path has been displaced from the coating hopper;

(e) flushing the at least one internal flow path of the coating hopper with water prior to the draining step;

(f) interrupting the flushing step;

(g) applying a surfactant to the lip of the coating hopper; and (h) resuming the flushing step.

2. A method as recited in claim 1 wherein:

there are at least two internal flow paths through the coating hopper.

3. A method as recited in claim 2 wherein:

the coating hopper is a slide hopper, and each of the at least two internal flow paths including a respective exit slot to a slide surface.

4. A method as recited in claim 3 further comprising the step of:

supplying a plurality of coating compositions each from a different source vessel, each different source vessel supplying coating composition to a respective one of the at least two internal flow paths.

5. A method as recited in claim 4 wherein:

the introducing step is performed to the at least two internal flow paths such that liquid composition is supplied to the one of the at least two internal flow paths that includes a lowest one of the exit slots first, and subsequently and sequentially to the internal flow paths including exit slots positioned higher on the slide surface.

6. A method as recited in claim 4 wherein:

the introducing step is performed such that all liquid coating compositions from each different source vessel reaches the respective exit slots substantially simultaneously.

7. A method as recited in claim 3 wherein:

the discharging step is performed such that the coating composition from the lowest one of the exit slots is discharged first, the coating composition being discharged from the other exit slots positioned higher on the slide surface subsequently and sequentially thereafter.

8. A method as recited in claim 3 comprising the step of:

applying the surfactant to the slide surface.

9. A method as recited in claim 2 further comprising the step of:

supplying a plurality of coating compositions each from a different source vessel, each different source vessel supplying coating composition to a respective one of the at least two internal flow paths.

10. A method as recited in claim 1 wherein:

the purge flow rate is greater than the predetermined coating flow rate.

11. A method as recited in claim 1 further comprising the step of:

the flushing step is performed at a flow rate that is greater than the predetermined coating flow rate.

12. A method as recited in claim 1 wherein:

the purge flow rate is not greater than the predetermined coating flow rate.

13. A method as recited in claim 1 wherein:

the coating hopper is an extrusion hopper.

14. A method for preparing a coating slide hopper prior to initiation of coating a liquid coating composition at a predetermined coating flow rate onto a moving substrate, the coating slide hopper having at least two internal flow paths therethrough exiting to a slide surface, the method comprising the steps of:

(a) supplying a plurality of coating compositions each from a different source vessel, each different source vessel supplying coating composition to a respective one of the at least two internal flow paths;

(b) introducing the liquid coating compositions respectively into each of the at least two internal flow path at a respective purge flow rate, the at least two internal flow paths not being water filled at the beginning of the introducing step;

(c) filling the at least two internal flow paths with the respective liquid coating compositions and discharging the liquid coating compositions from the at least two internal flow paths through respective exit slots of the coating hopper, the liquid coating compositions flowing over a lip of the coating hopper at the purge rate to a drain; and (d) maintaining the flow of the liquid coating composition through the at least two internal flow paths at the respective purge rate until air within the at least two internal flow paths has been displaced from the coating hopper; and wherein (e) the introducing step is performed to the at least two internal flow paths such that liquid composition is delivered to a lowest one of the exit slots first, and subsequently and sequentially to the exit slots positioned higher on the slide surface.

15. A method as recited in claim 14 wherein:

the coating hopper is a slide hopper.

16. A method as recited in claim 15 wherein:

the liquid coating composition discharges from the exit slot onto a slide surface of the slide hopper.

17. A method as recited in claim 14 wherein:

the coating hopper is an extrusion hopper.

18. A method as recited in claim 14 further comprising the step of:

(a) prior to the supplying step, draining the internal flow paths, and prior to the draing step, flushing the at least two internal flow path of the coating hopper with water;

(b) interrupting the flushing step;

(c) applying a surfactant to the slide surface and the lip of the coating hopper; and (d) resuming the flushing step.

19. A method for preparing a coating slide hopper prior to initiation of coating a liquid coating composition at a predetermined coating flow rate onto a moving substrate, the coating slide hopper having at least two internal flow paths therethrough exiting to a slide surface, the method comprising the steps of:

(a) supplying a plurality of coating compositions each from a different source vessel, each different source vessel supplying coating composition to a respective one of the at least two internal flow paths;

(b) introducing the liquid coating compositions respectively into each of the at least two internal flow path at a respective purge flow rate, the at least two internal flow paths not being water filled at the beginning of the introducing step;

(c) filling the at least two internal flow paths with the respective liquid coating composition and discharging the liquid coating compositions from the at least two internal flow paths through respective exit slots of the coating hopper, the liquid coating, compositions flowing over a lip of the coating hopper at the purge rate to a drain; and (d) maintaining the flow of the liquid coating compositions through the at least two internal flow paths at the respective purge rates until air within the at least two internal flow paths has been displaced from the coating hopper; and wherein (e) the introducing step is performed to the at least two internal flow paths such that initial flow of liquid composition arrives at respective slots of the at least two internal flow paths substantially simultaneously;

(f) prior to the supplying step, draining the internal flow paths, and prior to the draining step, flushing the at least two internal flow paths of the coating hopper with water;

(g) interrupting the flushing step;

(h) applying a surfactant to the slide surface and the lip of the coating hopper; and (i) resuming the flushing step.

* * * * *